US011313196B2

(12) United States Patent
Scott

(10) Patent No.: US 11,313,196 B2
(45) Date of Patent: Apr. 26, 2022

(54) METHOD FOR CONTINUED DRILLING OPERATIONS WITH A SINGLE ONE-PIECE WELLHEAD

(71) Applicant: Michael D. Scott, Oklahoma City, OK (US)

(72) Inventor: Michael D. Scott, Oklahoma City, OK (US)

( * ) Notice: Subject to any disclaimer, the term of this patent is extended or adjusted under 35 U.S.C. 154(b) by 0 days.

(21) Appl. No.: 16/900,345

(22) Filed: Jun. 12, 2020

(65) Prior Publication Data

US 2021/0388690 A1 Dec. 16, 2021

(51) Int. Cl.

| | |
|---|---|
| ***E21B 33/04*** | (2006.01) |
| ***E21B 33/06*** | (2006.01) |
| *E21B 17/04* | (2006.01) |

(52) U.S. Cl.

CPC ..... *E21B 33/04* (2013.01); *E21B 33/06* (2013.01); *E21B 17/04* (2013.01)

(58) Field of Classification Search

CPC ..... E21B 33/04; E21B 33/06; E21B 17/04

See application file for complete search history.

(56) References Cited

U.S. PATENT DOCUMENTS

| | | | |
|---|---|---|---|
| 4,353,420 | A | 10/1982 | Miller |
| 5,743,335 | A | 4/1998 | Bussear |
| 5,755,286 | A | 5/1998 | Ebinger |
| 7,140,445 | B2 | 11/2006 | Shahin et al. |
| 7,311,148 | B2 | 12/2007 | Giroux et al. |
| 2015/0096738 | A1 | 4/2015 | Atencio |
| 2017/0204714 | A1 | 7/2017 | Roesner |

*Primary Examiner* — Taras P Bemko

(74) *Attorney, Agent, or Firm* — Edward L White

(57) ABSTRACT

An improved method for continued drilling operation s with a single one-piece wellhead for drilling multi-wellbores eliminating the step of blowout preventer removal after drilling a second wellbore. An operator utilizing the improved method may utilize a single one-piece wellhead while drilling a series of wellbores through the blowout preventer with differing diameters without removing and reinstalling the blowout preventer between each drilling operation, eliminating testing of the seals after the reinstallation of the blowout preventer between the drilling subsequent wellbores.

7 Claims, 4 Drawing Sheets

METHOD FOR CONTINUED DRILLING OPERATIONS WITH A SINGLE ONE-PIECE WELLHEAD

CROSS-REFERENCE TO RELATED APPLICATIONS

None

FIELD OF THE INVENTION

The invention generally relates to oil and gas well drilling operations. In particular, the invention relates to an improved method that reduces the "wait on cement time," eliminates the blowout preventer removal and reinstallation between multi-string drilling operations, eliminates multiple pressure testing procedures, and increases safety by minimizing exposure to dangerous conditions during ongoing drilling operations.

BACKGROUND

In typical oil and gas recovery operations, a wellbore is formed to access hydrocarbon-bearing formations by drilling with a drill bit mounted on the end of a drill string. The wellbore is created by drilling to a predetermined depth where the drill string is rotated by a top drive or rotary table on a surface platform or drilling rig, or by a downhole motor mounted towards the lower end of the drill string. It is common to employ multiple casing strings within a wellbore. A conventional method to complete a well may include drilling to a first designated depth with a drill bit on a drill string. Then, the drill string is removed, and a surface casing is inserted into the wellbore. An annular area is formed between the string of surface casing and the formation. The surface casing may be temporarily hung from the surface of the well. The surface casing is cemented in place by forcing cement down through the surface casing and up between the outer wall of the surface casing and the formation to fill the annular area. A sufficient amount of curing time for the cement is required before a casing head may be affixed. The casing head is commonly affixed to the surface casing by welding. A blowout preventer is removably affixed to the casing head. The combination of the casing head and the blowout preventer is pressure tested to ensure functionality and no leaks, After successfully completing the pressure testing, the drill string and drill bit are reattached in preparation for continued drilling operations. The drill string is positioned within the blowout preventer and surface casing where another wellbore is drilled to a second desired depth, and a second string of casing, or liner, is run into the drilled-out portion of the wellbore. A second casing string is set at a depth such that the upper portion of the second string of casing overlaps the lower portion of the first string of casing. The second string is then held in place by slips or other methods known one skilled in the art, to temporarily retain the second string of casing in the wellbore. A slip is a well-known device used to suspend a casing string inside a wellhead. The second casing string is then cemented in place. Depending on the hydrocarbon formation, this process is typically repeated with additional casing strings including, but not limited to, a surface, an intermediate, a liner, and a production casing strings until the well has been drilled to a desired depth, Each casing is cemented in place as described above. The combination of cement and casing strengthens the wellbore and facilitates isolation of the adjacent formations. Wells are typically formed utilizing multiple wellbores and casing strings of an ever-decreasing diameter where the wellbore is concentric.

In the conventional method after the setting the surface casing and affixing the casing head, the blowout preventer is repeatedly removed and reinstalled to allow for the additional wellbores to be drilled. Every time the operator installs the blowout preventer on a casing head, casing spools, and tubing head, the combination must be tested for functionality and leaks. Additionally, the testing is frequently performed using a third-party service and the operator is subject to their testing schedule and associated cost. During the installation and removal procedure, the blowout preventer may be suspended in the air above the wellbore and workers, creating a potential safety hazard. As the drilling operations are ongoing, the casings may have to be cut. Typically, a worker utilizes a torch with an open flame to make to cut, which creates a potential safety risk. The operator may also have to rent different wellhead components as the well is being drilled and retain them until completion thus adding additional costs to the operator. The method described above has multiple issues, but the common factor is that they all rob the operator of time where they could be actively drilling or producing hydrocarbons. In the world of oil and gas, time is money, and any time lost is money lost.

SUMMARY OF THE INVENTION

The present invention overcomes these shortcomings by enabling an operator to install a single one-piece wellhead and drill a series of boreholes with differing diameters and differing depths without removing and reinstalling the blowout preventer between each drilling operation. The improved method for continued drilling operations with a single one-piece wellhead includes an operator drilling a first borehole to a desired depth for a surface casing, affixing a casing head on the surface casing, attaching a blowout preventer to casing head, and testing blowout preventer and casing head seals. The operator continues the improved method by extending multiple drill strings sequentially through the blowout preventer forming multiple wellbores, installing casings into each subsequent wellbore through the blowout preventer, removing the blowout preventer on completion of the drilling, removing and replacing the temporary pack-off bushing with the permanent pack-off bushing and installing a tubing head, and performing seal test.

The improved method eliminates the need to repeatedly install and remove the blowout preventer for each subsequent wellbore drilled, which in turn eliminates the requirement to perform testing (often by a third-party service, subjecting the operator to the third-party service's schedule). Additionally, the improved method increases the safety of the workers on the wellsite by minimizing the time the blowout preventer is suspended in the air overhead. Also, the improved method removes the need to cut the casing at the wellhead and increases safety of the wellsite. Next, the improved method eliminates the need to purchase or rent additional oilfield equipment and any delays caused by the oilfield equipment's availability. The improved method allows the operator to reduce the time required to drill the wellbore holes and prepare the well for production with increased safety. Additionally, the time to drill a producing well and manpower costs are greatly reduced.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

The improved method for continued drilling operations utilizes a single one-piece wellhead. The improved method eliminates the need to repeatedly remove and re-install the blowout preventer between each casing and tubing installed, which in turn eliminates the requirement to perform seal testing (often by a third-party service and subjecting the operator to the third-party service's schedule). This improved method increases the efficiency of drilling a well by reducing the time required to drill multiple wellbores in a single well and prepare the well for production. Overall, the improved method for continued drilling operations increases the efficiency of drilling a multi-string well, increases the safety of drilling operations and reduces to costs in time, manpower, and equipment.

Figure 3:
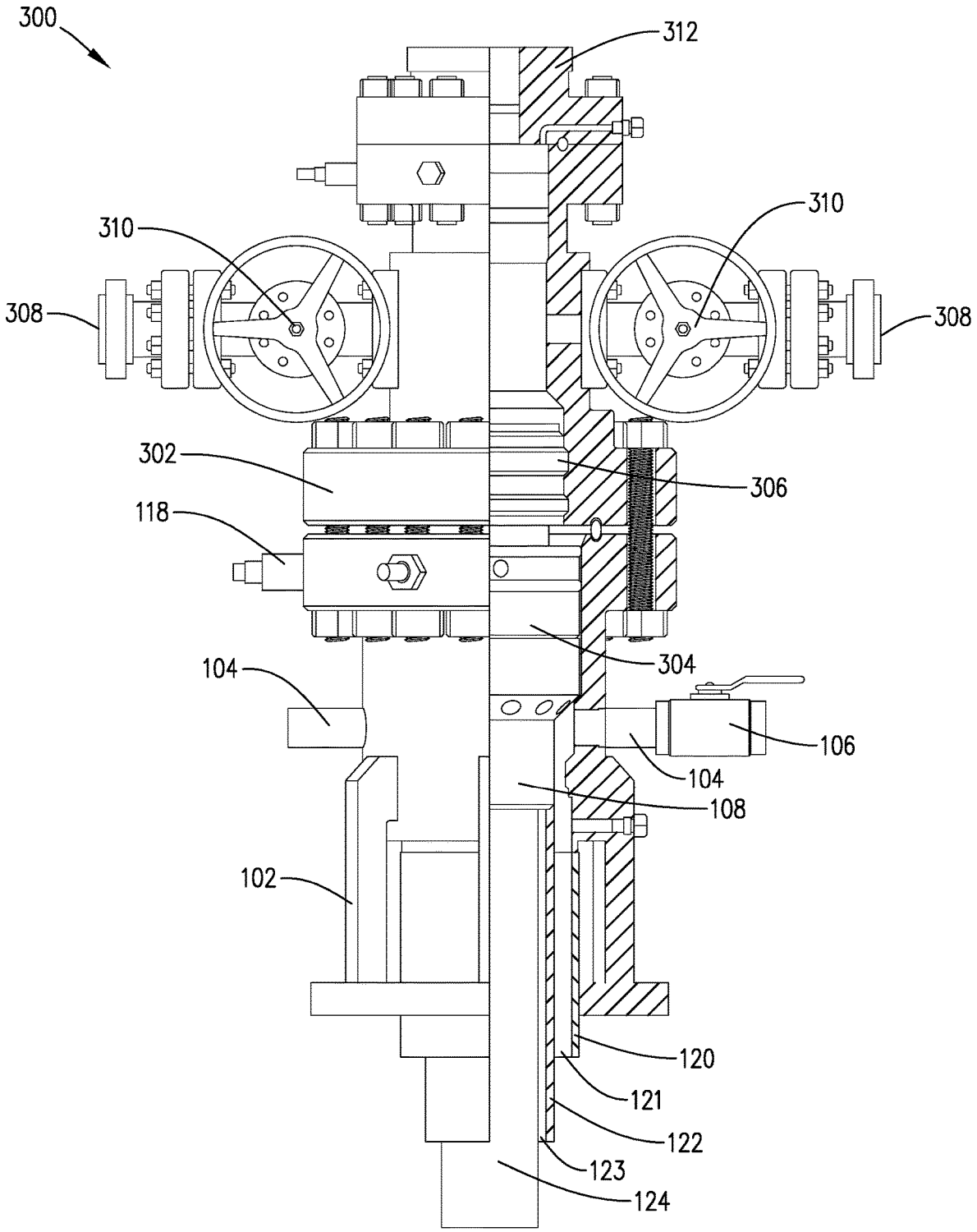
FIG. 3 is a side view, half in longitudinal cross-section, of the multi-string wellhead assembly.

The number of steps in the improved method are very similar to the number of steps in the method illustrated in FIG. 3 but the improvements are realized by reducing time to drill and put a well site into production, increasing safety during drilling operations, and lowering costs associated with chilling; operations. As an exemplar, the improved method reduces or eliminates the cement curing time that is known in the industry as the wait on cement time, which is typically around 8 hours. Further, the improved method eliminates the multiple removals and reinstallations of the blowout preventer as each casing string is run saving around 18 hours per casing string of drilling rig time during drilling operations. Additionally, without the multiple blowout preventer reinstallations, the improved method eliminates the requirement to have a third-party pressure test after each reinstallation of the blowout preventer to continue drilling operations. The time savings may be significant but is dependent on the third-party pressure tester's schedule and availability. The reduction in hours the drilling rig is on a wellsite translates into direct and indirect costs savings. The operating costs of a drilling rig may range from as little as $8,000.00 per day to $45,000.00 per day depending on the region and rig type. In this example, the direct costs savings could potentially range from $24,000.00 to $135,000.00 for the three days of drilling rig time. Additionally, the indirect cost savings may include opportunity costs of being able to start production early and to start drilling on a new well site.

The improved method also increases safety of the employees that are working at the wellsite. For example, the reduction of the multiple removals and reinstallations as discussed above, reduces the amount time workers may be working under a suspended blowout preventer and the possibility of an accident. Additionally, the improved method eliminates the need to torch cut the casings and production tubing at the at the wellhead.

The improved method reduces or eliminates the need for the to rent equipment as may be required in the non-improved method. For example, the operator may have to rent additional oilfield equipment such as spacer spools for each additional casing set. These additional pieces of oilfield equipment incur rental costs until the wellsite has been completed.

Figure 1:
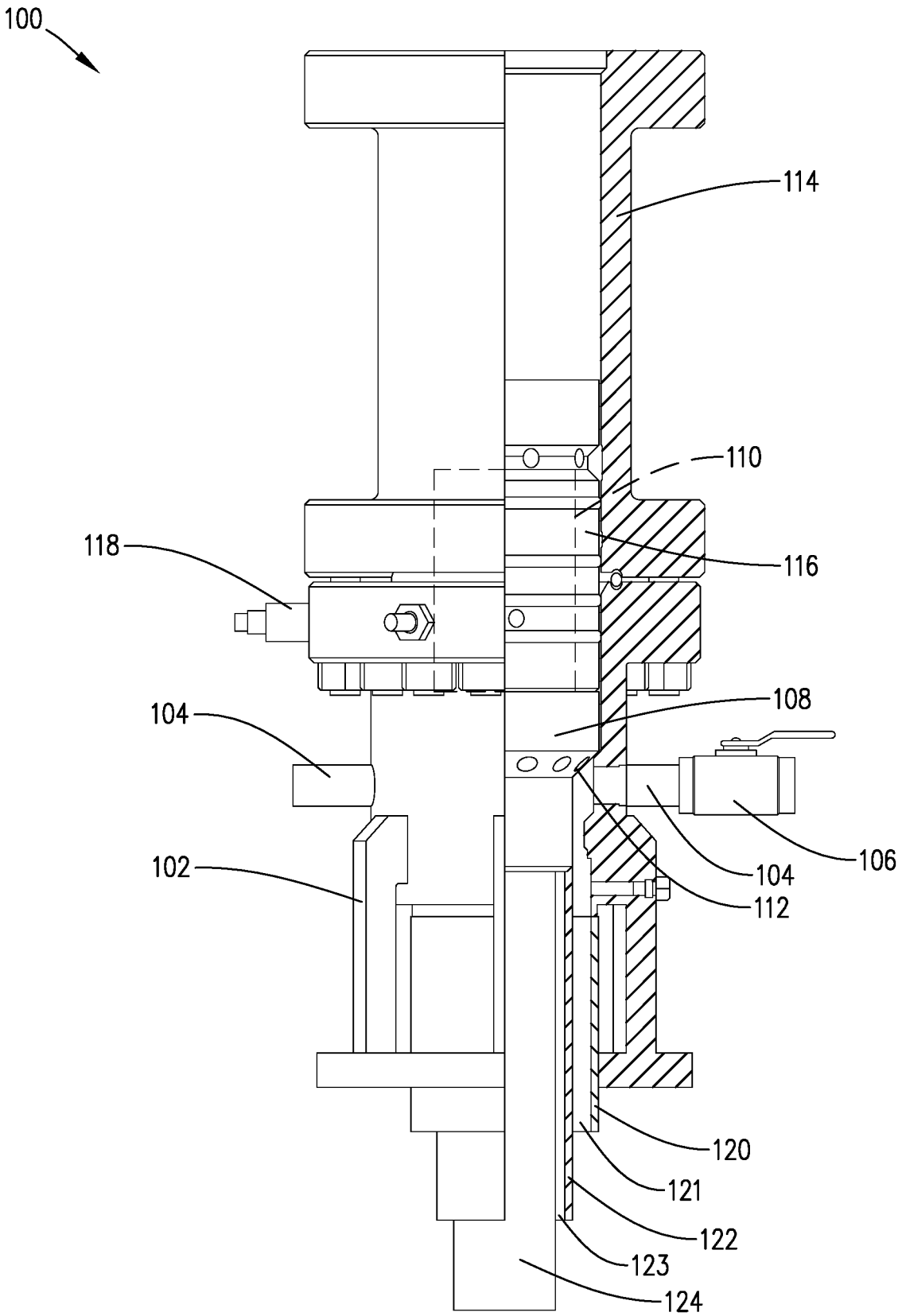
FIG. 1 is a side view, half in longitudinal cross-section, of the wellhead assembly with a blowout preventer.

FIG. 1 is a side view, half in a longitudinal cross-section, of the wellhead assembly 100. The wellhead assembly 100 may comprise a casing head 102 with a blowout preventer 114 removably affixed to the top of the casing head 102. The casing head 102 further comprises at least one annulus output 104, an annulus output valve 106, and a number of lock pins 118. While an annulus output valve 106 may be placed on both annulus outputs 104, a more common practice is that one of the annulus outputs 104 is plugged and the other annulus output 104 has an annulus output valve 106 removably affixed. One skilled in the art would determine which an annulus output 104 would receive an annulus output valve 106.

An operator may drill a series of wellbores to desired depths in order the extract hydrocarbons for the earth. The series of wellbores are generally concentric with the smallest wellbore being in the center and the largest being on the outside. A series of casing, liners, and tubing are installed in the wellbores. After a wellbore is drilled to a desired depth, the operator places a surface casing 120 into the wellbore to prevent contamination occurring as the hydrocarbons are brought to the surface. The surface casing 120 extends from the wellbore into the casing head 102 where the surface casing 120 may be rigidly affixed to the casing head 102 by welding. One skilled in the art may also threadedly affix the casing head 102 to the surface casing 120.

A subsequent wellbore may be drilled through the blowout preventer 114, where a casing string 122 may be position inside the second wellbore and surface casing 120. The casing string 122 may be rigidly or removably affixed to the casing head 102. An area between the surface casing 120 and the casing string 122 creates a casing annulus 121, through which any materials including, but not limited to, hydrocarbons, other fluids, or gases in the casing annulus 121 may be extracted through the annulus output 104. An annulus output valve 106 may be connected to the annulus output 104 to control the flow of the materials through the annulus output 104.

The operator may drill a third wellbore to a desired depth for the production tubing 124. The operator may insert production tubing 124 into the casing string 122 and the third wellbore. An area between the casing string 122 and the production tubing 124 creates a production annulus 123, through which any materials including, but not limited to, hydrocarbons, other fluids, or gases in the production annulus 123 may be extracted through the annulus output 104. Atop the production tubing 124 may be removably affixed to the fluted mandrel 108 to which the production tubing 124 may be suspended within the casing string 122. One skilled in the art may use multiple methods to suspend casings inside the casing head 102, including but not limited to, slips and mandrels. In the preferred embodiment, the production tubing 124 may threadedly engage a fluted mandrel 108 where the fluted mandrel 108 suspends the production tubing 124 in the casing string 122 and the third wellbore.

The fluted mandrel 108 may be positioned inside the casing head 102, where the fluted mandrel 108 engages the internal landing 112 of the casing head 102. The internal landing 112 prevents the fluted mandrel 108 from exiting through the bottom the of the casing head 102 and enables the production tubing 124 to be suspended from the fluted mandrel 108 within the wellbore. The internal landing 112 may be sloped to engage a corresponding sloped surface of the fluted mandrel 108.

A blowout preventer 114 may be removably affixed to the casing head 102 by fasteners known to one skilled in the art that are appropriate for the oilfield. The fluted mandrel extended neck 110 extends upward from the casing head 102 into the blowout preventer 114 where the casing head 102 may surround and enclose the upper portion of the fluted mandrel extended neck 110. A temporary pack-off bushing 116 may be placed onto the fluted mandrel extended neck 110 inside the blowout preventer 114 in casing head 102. The temporary pack-off bushing 116 seals the casing annulus 121 below from the production tubing 124 output above. An operator may adjust the lock pins 118 to engage the temporary pack-off bushing 116 to prevent the production tubing 124 from moving within the casing string 122.

A well may have multiple wellbores depending on several factors including, but not limited to, the number production zones beneath the wellsite, the type of drilling i.e. vertical and horizontal, the hydrocarbons being produced and any protected zones such as water aquifers. The number of well bores could be up to ten or more with one limitation being the sizes of available casings. In a common drilling configuration, there are three wellbores that require a surface casing, a casing string, and production tubing. In a standard drilling configuration, each additional casing and production tubing requires equipment to suspend the casings and tubing within the wellbore. This equipment may include hangar components including, but not limited to, casing spools and a tubing head. It would be apparent to one skilled in the art the number and type of oilfield equipment that may be required to suspend the casings in the wellbores. A current process in the field requires the blowout preventer 114 to be removed before the next casing hangar is installed and then replaced after the installation of the hanger.

Figure 2:
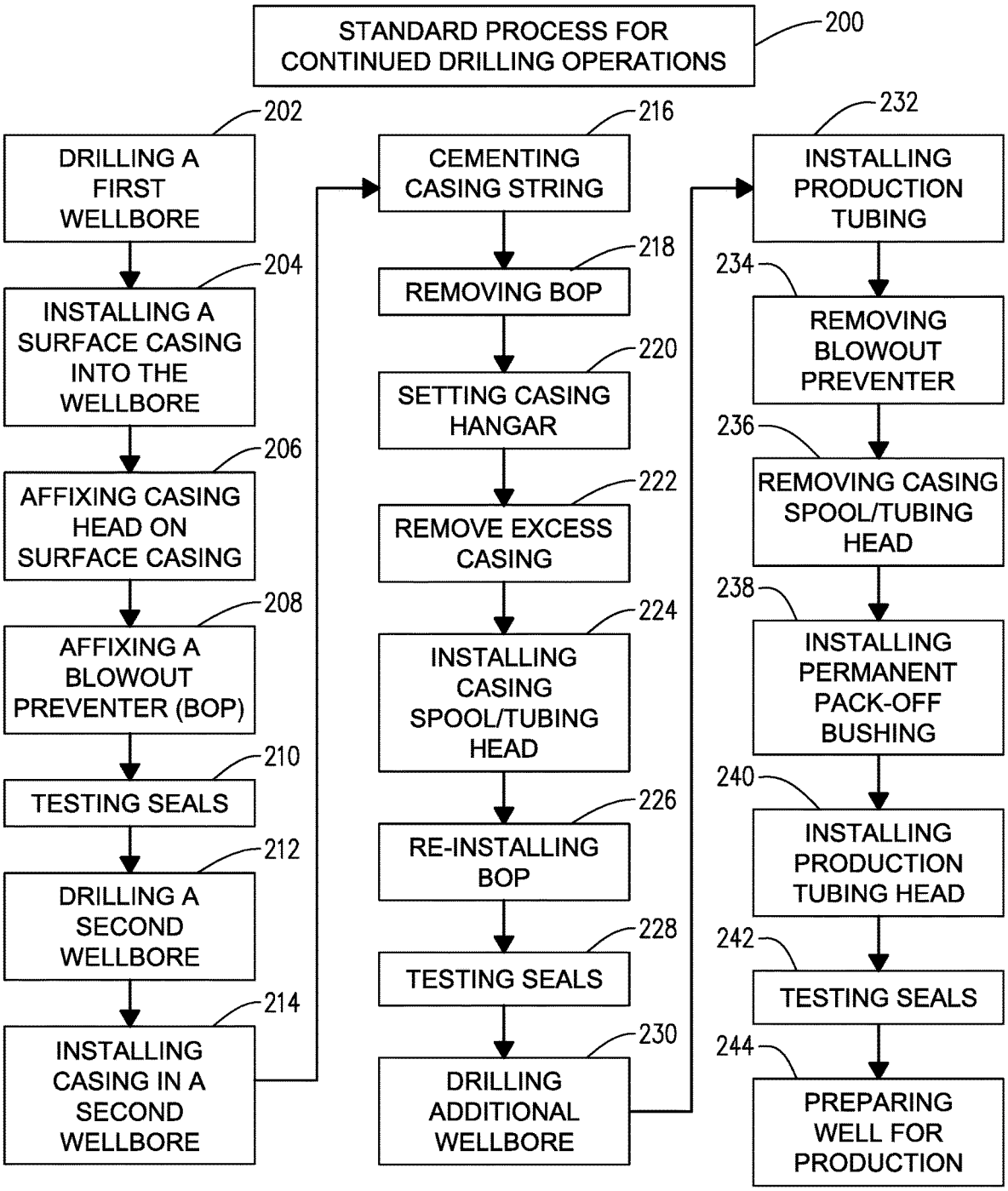
FIG. 2 is a process flow diagram illustrating a method for continued drilling operations.

FIG. 2 illustrates a method of the current process used in the field for continued drilling operations 200. In the first step 202 of the method for continued drilling operations 200, an operator drills a first wellbore into the earth. The operator's next step 204 is installing a surface casing 120 into the wellbore that was previously drilled in step 202. After the installation of the surface casing 120, the operator performs step 206 where the operator affixes the casing head 102 to the surface casing 120. In step 206, the casing head 102 is preferably welded to the surface casing 120. One skilled in the art may use other methods known in the oil and gas industry for affixing the casing head 102 to the surface casing 120. Once the casing head 102 has been affixed to the surface casing 120, the operator performs step 208 removably attaching the blowout preventer 114 to the casing head 102 with a plurality of fasteners that will withstand the temperatures and pressures from the oil and gas environment. When performing the testing seals in step 210, the operator may removably affix a cap to the top of the blowout preventer 114 with a plurality of fasteners to create a pressure seal between the cap and the blowout preventer 114. After the cap has been affixed, the operator applies internal pressure to blowout preventer 114 through a test port to test the seals of the wellhead assembly 100. After the operator has verified that the seals are functioning properly, the operator may perform the next step 212, drilling through the blowout preventer 114 and the casing head 102 to create a second wellbore 212. The second wellbore is concentric to the first wellbore and has a smaller diameter than the first wellbore. In step 214, the operator installs a casing string 122 into the second wellbore. After installing the casing string 122 in step 214, operator performs step 216, cementing the casing string 122. The operator forces cement down through the casing string 122 and up between the casing string 122 and the formation. Once the casing string 122 has been cemented in place, the operator performs step 218 by removing the blowout preventer 114.

After removing the blowout preventer 114, operator performs step 220 setting the casing hangar. Preferably, the operator uses slips herein incorporated by reference as the casing hangar, and the operator positions the slips around the exterior of the casing string 122 to position and hold the casing string 122 in the wellbore. After setting the casing hangar 220, the operator performs step 222 by removing the excess casing string 122 rising above the wellhead assembly 100. Generally, the operator removes the excess the casing string 122 by cutting the casing string 122 with a torch, typically an oxygen-acetylene torch at the wellhead assembly 100. After cutting the casing string 122, the operator may install a casing spool or tubing head on the casing string 122 completing step 224. The operator may determine whether a casing spool or a tubing head is installed based on the number of wellbores drilled at that well site. If other wellbores will be drilled at the well site, then the operator will likely use a casing spool on the intermediate casings and install a production tubing head 302 on the final casing or production tubing. Once the operator has installed the casing spool or tubing head on the casing string 122, the operator performs step 226 re-installing the blowout preventer 114 by removably affixing the blowout preventer 114 to the casing spool or tubing head attached to the casing string 122. Performing the testing seals step 228, the operator may removably affix a cap to the top of the blowout preventer 114 with a plurality of fasteners to create a pressure seal between the cap and the blowout preventer 114. After the cap has been affixed, the operator applies internal pressure to blowout preventer 114 through a test port to test the seals of the wellhead assembly 100 including the casing spools and blowout preventer 114. After the operator has verified that the seals are functioning properly, the operator may perform the next step 230, drilling through the blowout preventer 114 and the casing spool or tubing head to create a second additional wellbore. The second additional wellbore is usually concentric and has a smaller diameter than the first and second wellbores. Performing step 232, the operator installs a production tubing 124 into the additional wellbore. After installing the production tubing 124 in step 232, the operator performs step 234 removing the blowout preventer 114. Performing step 236, the operator removes the casing spool or the tubing head to facilitate step 238 installing the casing permanent pack-off bushing 306. Once the casing permanent pack-off bushing 306 is installed, the operator may install the production tubing head 302 to complete step 240. Upon completion of the installation of the production tubing head 302, the operator performs step 242, testing the seals. Testing the seals by the operator was described above. After the successful seal test, the operator may prepare the well for production completing step 244. Once these steps have been completed, the multi-wellbore well site is ready for hydrocarbon production.

FIG. 3 is a side view, half longitudinal cross-section, of the production wellhead assembly 300. In this configuration, the production wellhead assembly 300 may comprise a casing head 102, a production tubing head 302 and a cap 312. The casing head 102 was described previously in FIG. 1.

The production tubing head 302 may be removably affixed to the casing head 102 by fasteners known to one skilled in the art that are appropriate for the oilfield. After drilling the desired wellbores, the well site may then be configured for permanent hydrocarbon production. In preparing production wellhead assembly 300 for production, the temporary pack-off bushing 116 is removed and replaced with annulus permanent pack-off bushing 304. An operator may adjust the lock pins 118 to engage the annulus permanent pack-off bushing 304 to prevent the production tubing 124 from moving within the casing string 122. The annulus permanent pack-off bushing 304 seals the casing annulus 121 from the upper part of the production tubing head 302. The annulus permanent pack-off bushing 304 prevents hydrocarbons from entering the production tubing head 302 from the casing annulus 121 between the surface casing 120 and the casing string 122.

Additionally, a casing permanent pack-off bushing 306 may be placed over the fluted mandrel extended neck 110 and above the annulus permanent pack-off bushing 304 which then seals the production annulus 123. The production annulus 123 is fluidly connected to the annulus production outlets 308, where any materials including, but not limited to, hydrocarbons, other fluids, or gases in the production annulus 123 may be extracted through the production annulus outlets 308. The flow from the production annulus outlets 308 is controlled by the production annulus valves 310 removably affixed to the production tubing head 302. The hydrocarbons exiting the production wellbore enter the casing head 102 through the production tubing 124 where they pass through the fluted mandrel 108 and through the production tubing head 302 and exit the top of the production tubing head 302. As shown atop the production tubing head 302 is a cap 312. This cap 312 seals the production tubing head 302, and when production is desired the operator may removably affix an additional valve section above the production tubing head 302 to control the production of the hydrocarbons. However, other production configurations may require the cap 312 to be replaced with other types of oil field components depending on the requirements of the operator and the type of hydrocarbon operation.

Figure 4:
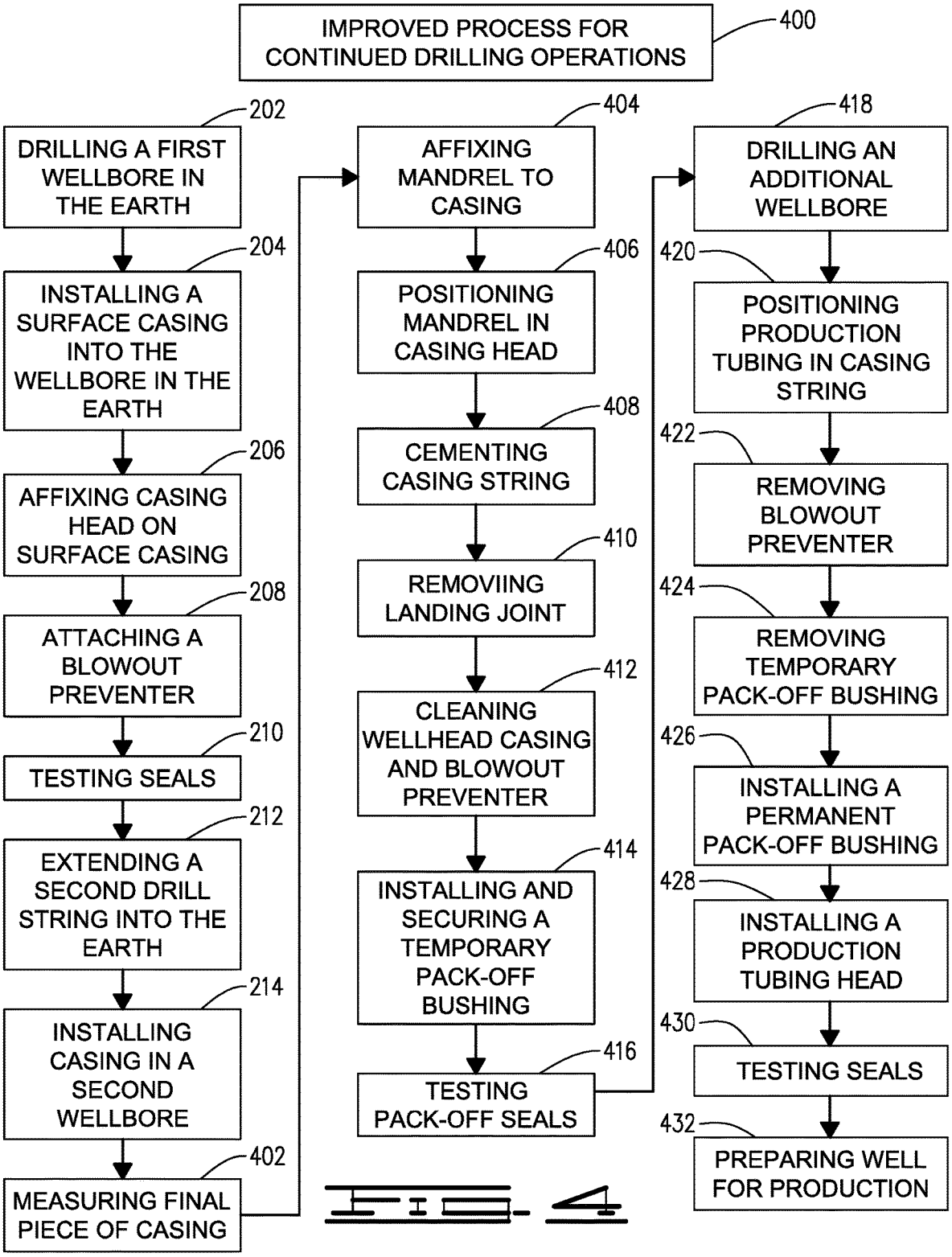
FIG. 4 is a process flow diagram illustrating an improved method for continued drilling operations.

FIG. 4 illustrates a method for an improved process for continued drilling operations 400. The method 400 may utilize the standard process for continued drilling operations steps 202 through 214. Steps going forward after 214 illustrate the improved process for continued drilling operations 400, the improved process 400 allows an operator to drill multiple wellbores without removing the blowout preventer 114 after the initial wellbore is completed and the blowout preventer 114 is installed. After completing step 214 installing casing in a second wellbore, the operator performs step 402 measuring final piece of casing string 122. After measuring the casing string 122, the operator may cut the casing string 122 away from the wellhead to the desired length and prepare the casing string 122 to be affixed to the fluted mandrel 108. Operator preforming step 404 removably affixes a fluted mandrel 108 to the measured piece of casing string 122. After affixing the fluted mandrel 108 to the casing string 122, the fluted mandrel 108 is positioned inside the casing head 102 completing step 406. The fluted mandrel 108 engages the internal landing 112 and suspends the casing string 122 in the first wellbore. Performing step 408, the operator cements the casing string 122 into position where the cement is pumped down through the casing string 122 and up between the outside of the casing string 122 and the formation to seal the formation. After the second wellbore has been cemented, the operator may perform step 410 by removing the landing joint and cleaning the casing head 102 and blowout preventer 114 to complete step 412. Once the casing head 102 and blowout preventer 114 are sufficiently cleaned, operator continues with step 414, where they slide the temporary pack-off bushing 116 over the fluted mandrel extended neck 110 positioned in the casing head 102 and blowout preventer 114. The temporary pack-off bushing 116 is slid down fluted mandrel extended neck 110 to engage the landing on the top of the fluted mandrel 108. Once the temporary pack-off bushing 116 is in the desired position, the operator may engage the lock pins 118 to secure the temporary pack-off bushing 116 in place, thus completing step 414. Performing the testing seals step 416, the operator may removably affix a cap 312 to the top of the blowout preventer 114 with a plurality of fasteners to create a pressure seal between the cap 312 and the blowout preventer 114. After the cap 312 has been affixed, the operator applies internal pressure preferably with a hand test pump to blowout preventer 114 through a test port to test the seals of the wellhead assembly 100. After the operator has verified that the seals are functioning properly, the operator may continue to the next step 418. Performing step 418 drilling an additional wellbore, the operator drills through the blowout preventer 114 and casing head 102 into the previous wellbores and casings to create an additional wellbore. Once the wellbore is drilled to the desired depth, production tubing 124 may be landed inside the casing string 122 completing step 420. After landing the production tubing 124, the operator performs step 422 by removing the blowout preventer 114 and continues to step 424 by removing the temporary pack-off bushing 116. After the blowout preventer 114 and the temporary pack-off bushing 116 have been removed, performing step 426, the operator may then install a casing permanent pack-off bushing 306. Once the casing permanent pack-off bushing 306 has been installed, a production tubing head 302 may be affixed to the production tubing 124 to complete step 428. Operator performs step 430 testing the seals, to ensure functionality and no leaking. After determining the seals are functional, the operator continues to step 432 preparing the well for production.

Having thus described the invention, I claim:

1. An improved method for continued drilling operation with a single one-piece wellhead, drilling a first wellbore into a earth to a first desired depth, installing a surface casing in the first wellbore, affixing a casing head to the surface casing, removably affixing a blowout preventer to a wellhead casing, performing a first seal test of the blowout preventer and wellhead casing seals, drilling through the blowout preventer a second wellbore to a second desired depth, installing an intermediate casing into the second wellbore to second desired depth, cementing the intermediate casing in a desired position, removing the blowout preventer, setting a casing hangar and removing intermediate casing with a torch, installing a casing spool or a tubing head to the intermediate casing, reinstalling the blowout preventer and testing seals, drilling through the blowout preventer any subsequent wellbore to any subsequent desired depth, installing production tubing through the blowout preventer and the intermediate casing and in the borehole to any subsequent desired depth, removing the blowout preventer, removing the casing spool or the tubing head affixed to the intermediate casing, removing a temporary pack-off bushing, installing a permanent pack-off bushing, installing a production tubing head, testing the seals and installing a production valve assembly, the improvement comprising the steps of:

a. eliminating the step of removing the blowout preventer after drilling the second wellbore;
b. measuring the second wellbore for a length required for a last section of the intermediate casing;
c. removing the intermediate casing from the last section of the intermediate casing based on the previous measurement and creating a measured intermediate casing;
d. affixing a mandrel to the measured intermediate casing and positioning the mandrel and the measured intermediate casing inside the wellhead and the surface casing;
e. rigidly affixing the measured intermediate casing in a second desired position within the second wellbore by forcing cement down through the intermediate casings and up between the intermediate casings and the earth, rigidly fixing the position of the intermediate casing within the second wellbore;
f. cleaning wellhead casings and the blowout preventer, aiding in setting of the temporary pack-off bushing;
g. installing and securing the temporary pack-off bushing through the blowout preventer;
h. performing a second seal test;
i. drilling through the blowout preventer third wellbore into the earth to a third desired depth;
j. installing production tubing through the blowout preventer to the third desired depth in the third wellbore;
k. removing and replacing the temporary pack-off bushing through the blowout preventer with a permanent pack-off bushing and securing the permanent pack-off bushing;
l. removing the blowout preventer;
m. installing the production tubing head; and
n. performing a third seal test, whereby an operator may utilize a single one-piece wellhead while drilling a series of wellbores through the blowout preventer with differing diameters without removing and reinstalling the blowout preventer between each drilling operation, eliminating testing of the seals after the reinstallation of the blowout preventer between the wellbore drilling of each wellbores which required seals testing after the initial installation of the blowout preventer and after the installation of the production tubing head, and eliminating the installation and removal of casing spool and tubing head for each of the intermediate casing steps.

2. The method of claim 1, where the mandrel is fluted.

3. The method of claim 1, where the length of the last section of intermediate casing is measured using a running tool.

4. The method of claim 1, where the mandrel is rotatable and affixed to a last section of intermediate casing in the wellhead and rotated to set the intermediate casing to the desired position.

5. The method of claim 1, where the operator tests the seals using a test pump, supplying a pressure through an external test port in the wellhead.

6. The method of claim 1, where the operator removes an excess of the intermediate casing away from the wellhead.

7. The method of claim 1 where a fourth wellbore is to be drilled, and the blowout preventer is not removed between drilling the third and forth wellbores.

* * * * *